US006205984B1

(12) United States Patent
Renard

(10) Patent No.: US 6,205,984 B1
(45) Date of Patent: Mar. 27, 2001

(54) FUEL TREATMENT DEVICES

(76) Inventor: Regis E. Renard, 540 Columbia Valley Rd., Lindell Beach, British Columbia (CA), V2R 4X6

( * ) Notice: Subject to any disclaimer, the term of this patent is extended or adjusted under 35 U.S.C. 154(b) by 0 days.

(21) Appl. No.: 09/414,451

(22) Filed: Oct. 7, 1999

(51) Int. Cl.[7] ..... F02M 27/00
(52) U.S. Cl. ..... 123/538
(58) Field of Search ..... 123/536, 537, 123/538

(56) References Cited

U.S. PATENT DOCUMENTS

| | | | | |
|---|---|---|---|---|
| 4,429,665 | * | 2/1984 | Brown | 123/538 |
| 4,715,325 | | 12/1987 | Walker . | |
| 5,044,347 | * | 9/1991 | Ullrich et al. | 123/538 |
| 5,048,499 | * | 9/1991 | Daywalt | 123/538 |
| 5,059,217 | * | 10/1991 | Arroyo et al. | 123/538 |
| 5,069,190 | | 12/1991 | Richards | 123/538 |
| 5,092,303 | | 3/1992 | Brown | 123/538 |
| 5,258,108 | | 11/1993 | Cassidy . | |
| 5,307,779 | | 5/1994 | Wood et al. | 123/538 |
| 5,344,606 | | 9/1994 | Brimmer . | |
| 5,368,705 | | 11/1994 | Cassidy . | |
| 5,393,723 | | 2/1995 | Finkl . | |
| 5,580,359 | | 12/1996 | Wright . | |
| 5,738,692 | | 4/1998 | Wright . | |
| 6,024,073 | * | 2/2000 | Butt | 123/538 |
| 6,053,152 | * | 4/2000 | Ratner | 123/538 |

* cited by examiner

*Primary Examiner*—Marguerite McMahon

(57) ABSTRACT

A fuel treatment device, comprises a housing defining a fuel flow passage, the housing having a fuel inlet and a fuel outlet which communicate with the fuel flow passage, and the fuel inlet and the fuel outlet each having a fuel line connector, and a catalyst located in the fuel flow passage, the catalyst comprising a bismuth alloy. The catalyst comprises an elongate element of cruciform cross-section extending longitudinally of the fuel flow passage and the elongate element comprises a pair of elongate components formed with a slot extending longitudinally thereof to allow longitudinal interengagement of the elongate components.

13 Claims, 5 Drawing Sheets

FUEL TREATMENT DEVICES

BACKGROUND OF THE INVENTION

1. Field of the Invention

The present invention relates to fuel treatment devices and, more particularly, to fuel treatment devices in turn to be installed in a fuel supply line of an engine.

2. Description of the Related Art

It has previously been proposed, in U.S. Pat. No. 4,492,665, issued Feb. 7, 1994 to Bill H. Brown, to provide a device and a method for treating liquid fuels, to improve the combustion characteristics of the fuels in internal combustion engines, by inserting an elongate metal bar in a casing through which the fluid flows, the metal bar comprising an alloy of nickel, zinc, copper, tin and silver. The metal bar is preferably of triangular cross-sectional area so as to have the exterior surfaces in contact with the fuel and the exterior surfaces of the bar have space-apart elevated ridges for promoting turbulence in the fuel flowing through the fuel casing.

BRIEF SUMMARY OF THE INVENTION

The present inventor has found that improved results in the treatment of engine fuel can be achieved by passing the fuel over a catalyst comprising a bismuth alloy.

More particularly, according to the present invention a fluid treatment device comprises a housing defining a fuel flow passage, the housing having a fuel inlet and a fuel outlet which communicate with the fuel flow passage, and the fuel inlet and the fuel outlet each having a fuel line connector. A catalyst is located in the fuel flow passage and comprises, in parts percent by weight, 2–5% nickel, 40–65% tin, 10–30% bismuth, 2–10% lead and 1–5% mercury.

Preferably, the catalyst comprises an elongate element of cruciform cross-section, which extends longitudinally of the fuel flow passage. In a preferred embodiment of the invention, the elongate element comprises a pair of elongate components, each of which is formed with a slot extending longitudinally thereof to allow longitudinal interengagement of the elongate components.

BRIEF DESCRIPTION OF THE DRAWINGS

The invention will be more readily understood from the following description of preferred embodiments thereof, by way of example, with reference to the accompanying drawings, in which.

DESCRIPTION OF THE PREFERRED EMBODIMENTS

Figure 1:
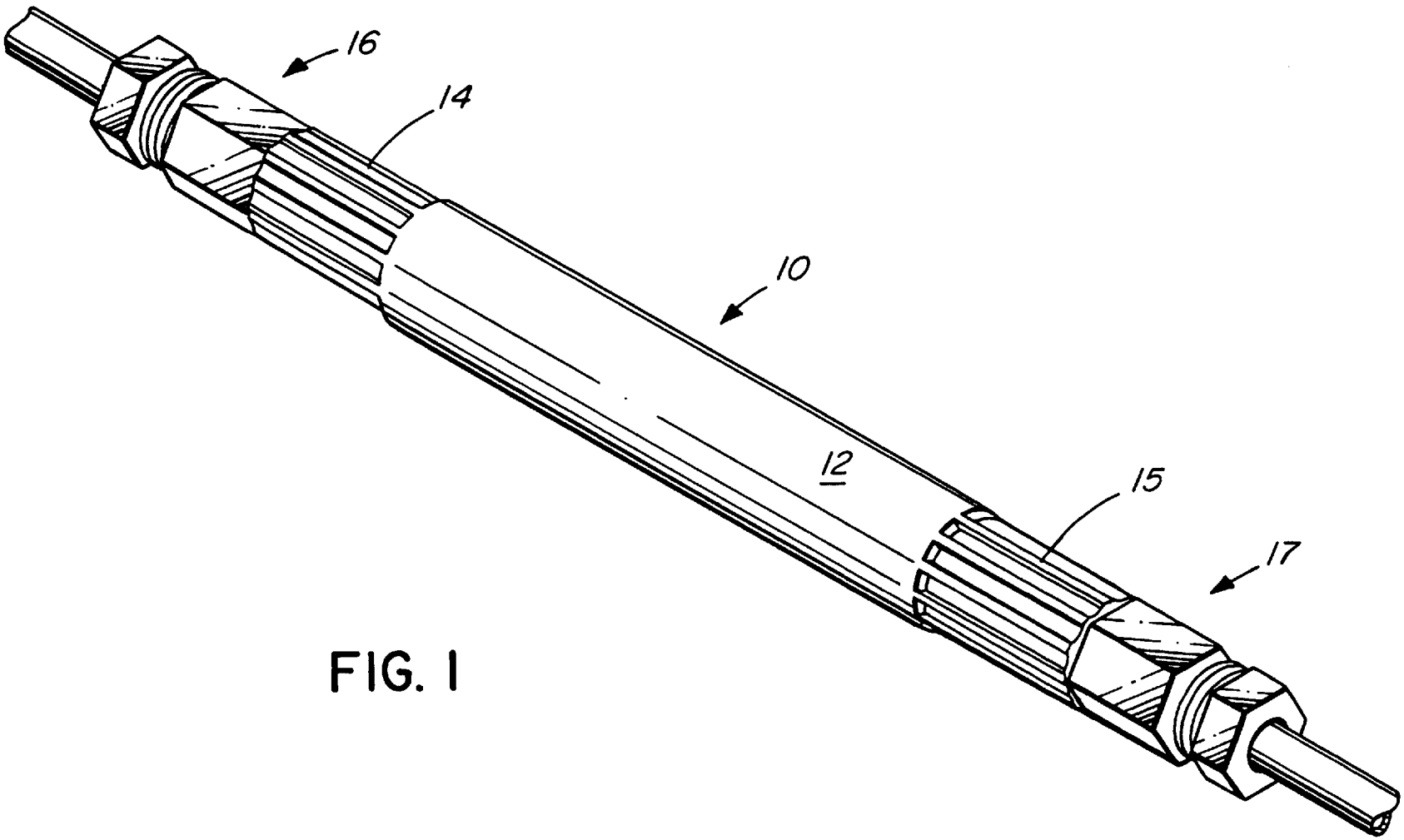
FIG. 1 shows a view in perspective of a fuel treatment device embodying the present invention.

In FIG. 1 of the accompanying drawings there is illustrated a fuel treatment device which is indicated generally by reference numeral 10. The fuel treatment device 10 comprises a tubular copper housing 12 having opposite end portions 14 and 15 which are crimped onto fuel line connectors indicated generally by reference numerals 16 and 17.

Figure 2:
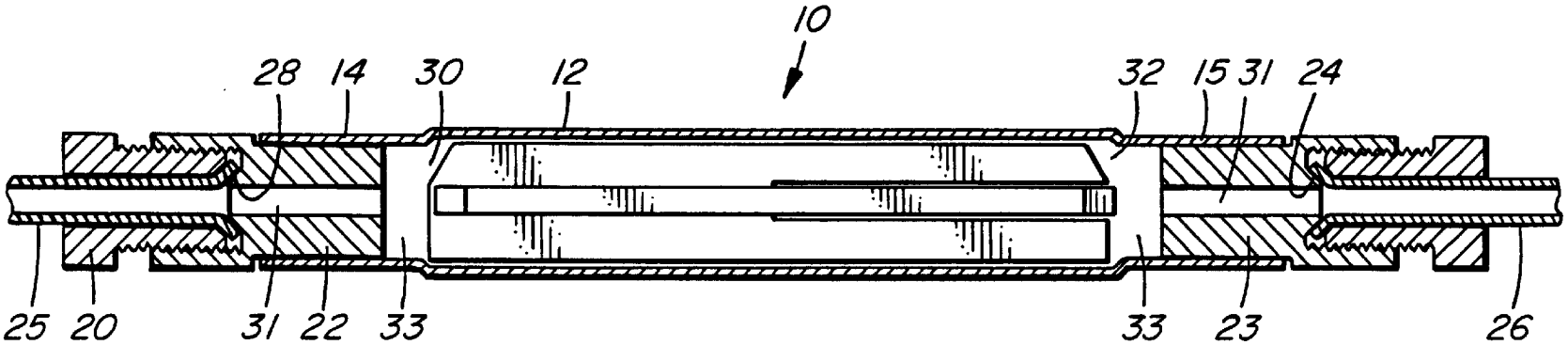
FIG. 2 shows a view taken in longitudinal cross-section through the fuel treatment device of FIG. 1.

The fuel line connectors comprise lock nuts 20 and 21 in threaded engagement with bushings 22 and 23, onto which the housing end portions 14 and 15 are crimped. As can be seen in FIG. 2, end portions 25 and 26 of a fuel line, which are connected by the fuel treatment device 10, are inserted through the lock nuts 20 and 21, the fuel line end portions 25 and 26 having flared ends 28 and 29 which, in known manner, are clamped between the bushings 22 and 23 and the lock nuts 20 and 21 so as to tightly seal the fuel line end portions 25 and 26 to the fuel treatment device 10.

Between the fuel line connectors 16 and 17 the tubular copper housing 12 defines a cylindrical fuel flow passage 30 which, at opposite ends, communicates with borings 31 extending through the bushings 22 and 23 to the fuel line end portions 25 and 26.

The passage 30 contains a catalyst in the form of a catalyst element indicated generally by reference numeral 32, which extends longitudinally of the fuel flow passage 30 and opposite ends of the catalyst element 32 are spaced from the bushings 22 and 23 by gaps 33.

Figure 3:
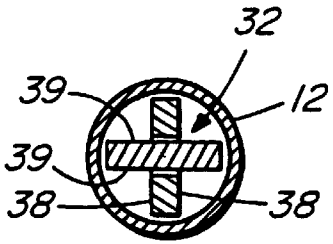
FIG. 3 shows a view taken in transverse cross-section trough a fuel treatment device of FIG. 1.
Figures 4, 5, 6:
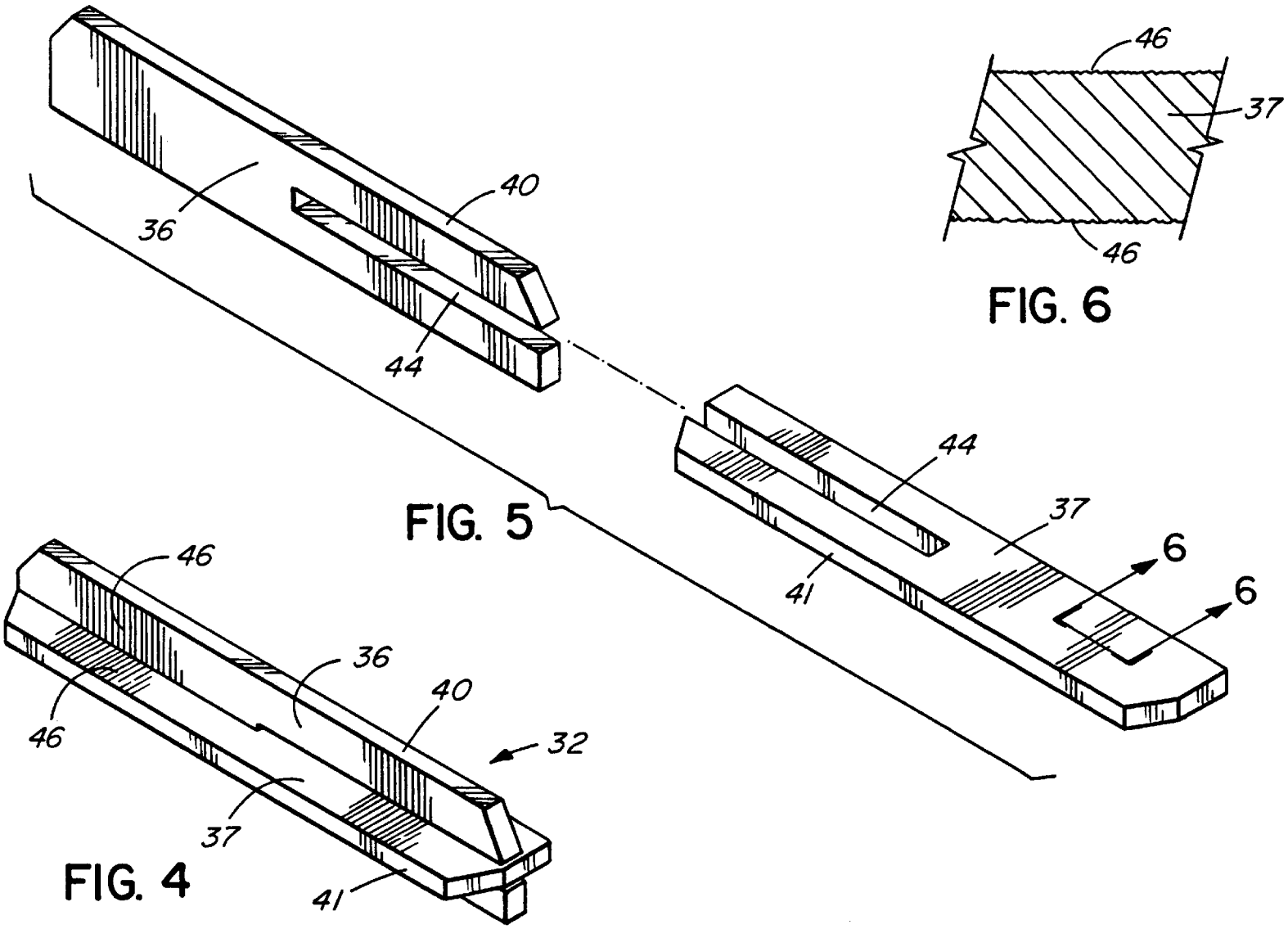
FIG. 4 shows a view in perspective of a catalyst element forming part of the fuel treatment device of FIGS. 1 through 3.
FIG. 5 shows a view in perspective of two components of the catalyst component of FIG. 4.
FIG. 6 shows a broken-away view taken in cross-section along the line 6—6 of FIG. 5.

As can been seen more clearly from FIGS. 4 and 5, the catalyst element 32 is formed by two elongate components 36 and 37, which have opposite elongate longitudinal major surfaces 38 and 39 and longitudinal edges 40 and 41 and which are mutually interengaged, at right angles to one another, so that the catalyst element 32 has a cruciform shape, as can been seen from FIGS. 3 and 4.

More particularly, each of the elongate components 36 and 37 is formed with a slot 44 extending substantially halfway along the respective component, and by means of these slots 44 the two elongate components 36 and 37 are longitudinally slidably interengaged.

The above-described cruciform shape of the catalyst element 32 has the advantage that the fuel flows along most of the major surfaces 38 and 39 of the elongate components 36 and 37 and is therefore exposed to the alloys from which these components are made, as described in greater detail below.

In order to promote the contact of the fuel with these major surfaces 38 and 39, recesses in the form of knurling 46 are formed in the major surfaces 38 and 39 so as to promote turbulence in the flow of the fuel as the fuel travels along and in contact with the major surfaces 38 and 39.

FIG. 6 shows the knurling 46 on the major surfaces 38 and 39 of the elongate component 39 in greater detail.

Figure 7:
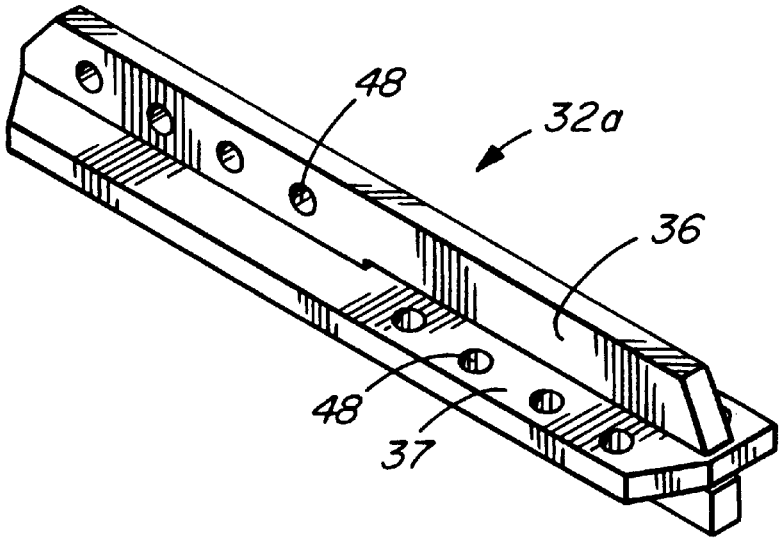
FIGS. 7 through 11 show views in perspective of modifications of the catalyst element of FIGS. 4 and 5.

Other types of recesses can be formed in the elongate components 36 and 37 in order to promote the above-described fuel flow turbulence. Thus, for example, FIG. 7 shows a modification of the elongate catalyst element 32, indicated generally by reference numeral 32*a*, in which the elongate components 36 and 37 are formed with through-holes 48 in addition to the knurling 46.

Figure 8:
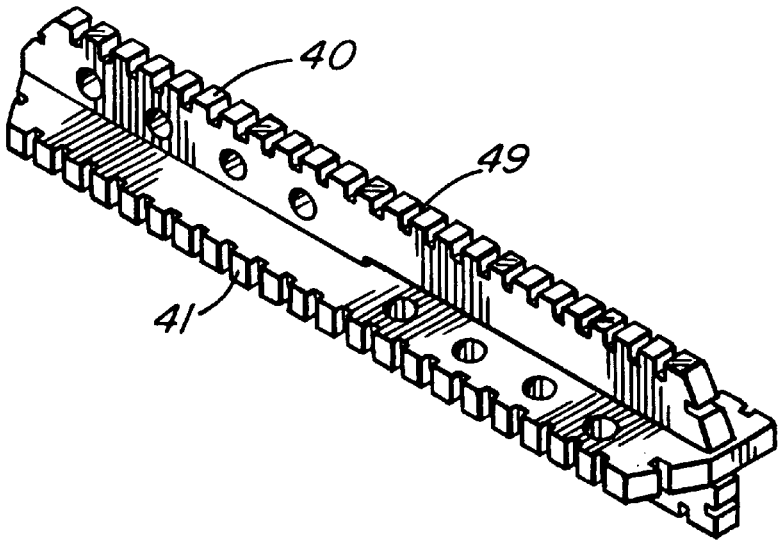

In FIG. 8, is shown a further modification in which the outer edge surfaces 40 and 41 of the elongate components are provided with a plurality of transverse grooves 49.

Figure 9:
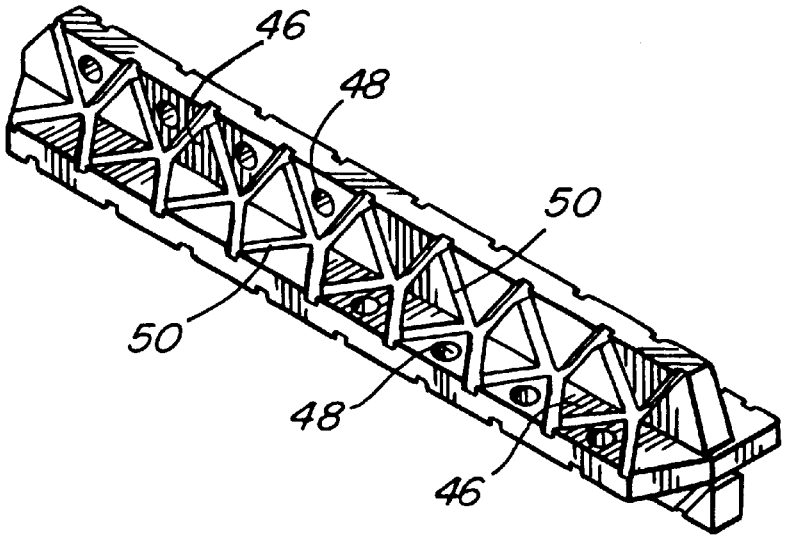

In the modification of FIG. 9, and in addition to the knurling 46 and the through-holes 48, the elongate components are formed with mutually angularly disposed grooves 50.

Figure 10:
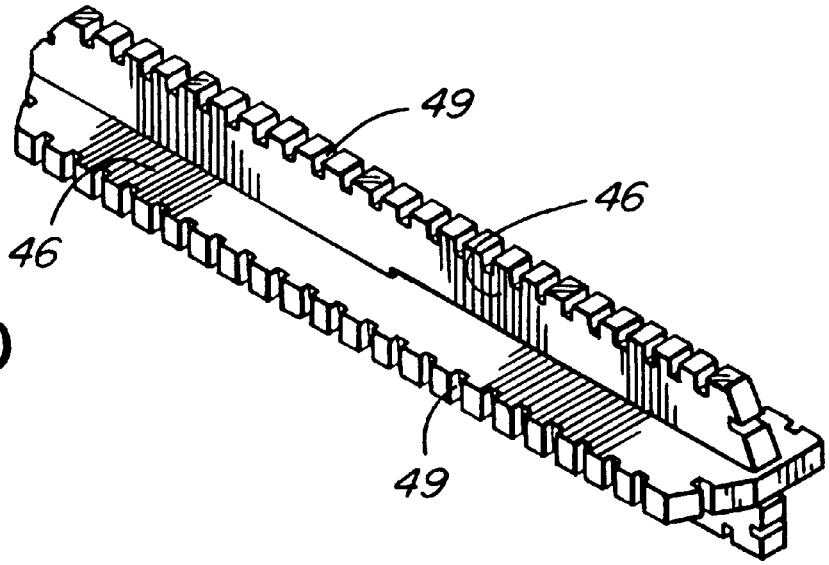
Figure 11:
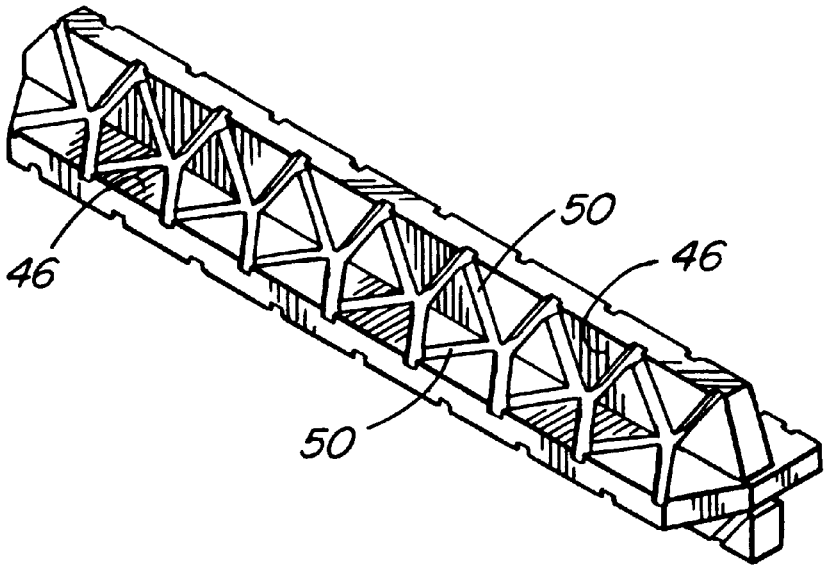

FIGS. 10 and 11 show modifications corresponding, respectively to those of FIGS. 8 and 9 but with the through-holes 48 omitted.

The above-described elongate cruciform cross-sectional shape of the catalyst element has the advantage that it does not obstruct the fuel flow to a substantial extent, but allows turbulence in the fuel and promotes contact of the fuel over a major portion of the major surfaces of the catalyst element.

It has been found that the efficiency of the present device is improved by the use of a bismuth allow as the catalyst element.

More particularly, an alloy having a composition within the following range has been found to be effective:

2–5% nickel

50–70% tin

5–20% bismuth

5–10% lead

5–10% zinc

In this case, the following composition is preferred:

EXAMPLE I

5%—nickel

70% tin

15% bismuth

5% lead

5% zinc

Another range which has been found to be effective is as follows:

2–5% nickel

40–65% tin

10–30% bismuth

2–10% lead

1–5% mercury

In this case, the composition is preferably as follows:

EXAMPLE II

5% nickel

60% tin

20% bismuth

10% lead

5% mercury

A third range which has also been found to be effective is as follows:

1–5% silver

10–25% zinc

40–65% tin

2–15% copper

10–30% bismuth

In this case, the following composition is preferred:

EXAMPLE III

1% silver

15% zinc

59% tin

10% copper

15% bismuth

The above compositions and ranges are all expressed in parts percent by weight.

Figure 12:
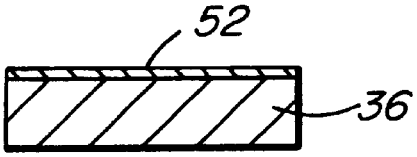
FIG. 12 shows a view in transverse cross-section through on of the components of FIG. 5.

Also, it has been found that the effectiveness of the present invention can be improved by providing a coating of platinum, having a thickness of not more than 1/1000th inch, on one side of one of the elongate components of the catalyst element. For example, as illustrated in FIG. 12, t/he platinum may be electrolytically applied as a coating 52 on the elongate component 36.

It is believed that, by virtue of the turbulence and friction of the fuel flow over the surfaces of the catalyst element, there is produced in the fuel a modification of the molecular structure of the fuel which results in more complete combustion of the fuel in the engine, which is not shown and that this improved combustion provides increased engine power, improved milage, quicker starting, reduced pollution emissions, reduced carbon buildup in the engine and an extension of the engines life.

The gaps 33 between the catalyst element 32 and the bushings 22 and 23 further promote turbulence in the fuel flow without significantly obstructing the fuel flow.

I claim:

1. A fuel treatment device, comprising:

a housing defining a fuel flow passage;

said housing having a fuel inlet and a fuel outlet which communicate with said fuel flow passage, and said fuel inlet and said fuel outlet each having a fuel line connector; and a catalyst located in said fuel flow passage;

said catalyst comprising a bismuth allow;

said bismuth alloy comprising, in parts percent by weight:

2–5% nickel

40–65% tin

10–30% bismuth

2–10% lead

1–5% mercury.

2. A fuel treatment device as claimed in claim 1, wherein said bismuth alloy comprises, in parts percent by weight:

5% nickel

60% tin

20% bismuth

10% lead

5% mercury.

3. A fuel treatment device as claimed in claim 1, wherein said catalyst comprises an elongate element of cruciform cross-section, said elongate element extending longitudinally of said fuel flow passage.

4. A fuel treatment device as claimed in claim 3, wherein said elongate element comprises a pair of elongate components, said elongate components each being formed with a slot extending longitudinally thereof to allow longitudinal interengagement of said elongate components.

5. A fuel treatment device as claimed in claim 4, wherein said elongate components have knurled elongate major surfaces.

6. A fuel treatment device as claimed in claim 4, wherein said elongate components have grooved elongate major surfaces.

7. A fuel treatment device as claimed in claim 4, wherein said elongate components have notched longitudinal edge surfaces.

8. A fuel treatment device as claimed in claim 4, wherein said elongate components are each formed with a plurality of through-holes.

9. A fuel treatment device, comprising:

a housing defining a fuel flow passage;

said housing having a fuel inlet and a fuel outlet which communicate with said fuel flow passage, and said fuel inlet and said fuel outlet each having a fuel line connector, and a catalyst located in said fuel flow passage;

said catalyst comprising a bismuth alloy;

said catalyst comprising an elongate element of cruciform cross-section;

said elongate element extending longitudinally of said fuel flow passage;

said elongate element comprising a pair of elongate components; and said elongate components each being formed with a slot extending longitudinally thereof to allow longitudinal interengagement of said elongate components.

10. A fuel treatment device as claimed in claim 9, wherein said elongate components have knurled elongate major surfaces.

11. A fuel treatment device as claimed in claim 9, wherein said elongate components have grooved elongate major surfaces.

12. A fuel treatment device as claimed in claim 9, wherein said elongate components have notched longitudinal edge surfaces.

13. A fuel treatment device as claimed in claim 9, wherein said elongate components are each formed with a plurality of through-holes.

* * * * *